US006450139B1

(12) United States Patent
Watanabe

(10) Patent No.: US 6,450,139 B1
(45) Date of Patent: Sep. 17, 2002

(54) VALVE TIMING CONTROL SYSTEM FOR INTERNAL COMBUSTION ENGINE

(75) Inventor: Kotaro Watanabe, Farmington Hills, MI (US)

(73) Assignee: Unisia Jecs Corporation, Atsugi (JP)

( * ) Notice: Subject to any disclaimer, the term of this patent is extended or adjusted under 35 U.S.C. 154(b) by 0 days.

(21) Appl. No.: 09/969,662

(22) Filed: Oct. 4, 2001

(30) Foreign Application Priority Data

Oct. 20, 2000 (JP) ..... 2000-320488

(51) Int. Cl.[7] ..... F01L 1/34
(52) U.S. Cl. ..... 123/90.17; 123/90.31
(58) Field of Search ..... 123/90.15, 90.17, 123/90.31

(56) References Cited

U.S. PATENT DOCUMENTS 6,269,785 B1 * 8/2001 Adachi ..... 123/90.17
6,325,031 B1 * 12/2001 Takano ..... 123/90.17

FOREIGN PATENT DOCUMENTS

JP 9-280020 10/1997
JP 10-110603 4/1998

* cited by examiner

*Primary Examiner*—Weilun Lo
(74) *Attorney, Agent, or Firm*—Foley & Lardner

(57) ABSTRACT

A valve timing control system for an internal combustion engine. The valve timing control system comprises a rotation control mechanism including a housing, and a vane rotor rotatably disposed inside the housing and having at least one vane section. The vane section defines a first chamber and a second chamber which are located on opposite sides of the vane section, hydraulic pressure being selectively supplied to and released from the first chamber and the second chamber so as to controllably accomplish a relative rotation of the vane rotor to the housing. The vane rotor is formed at its axially end section with a depression. A first camshaft is connected to the vane rotor by a cam bolt piercing the vane rotor along an axis of the vane rotor. A second camshaft is disposed parallel with the first camshaft. A first driving force transmission member is installed to the housing and connected to one of a crankshaft and the second camshaft. Additionally, a second driving force transmission member is installed to an end section of the first camshaft together with the vane rotor by the cam bolt and connected to the other of the crankshaft and the second camshaft. The second driving force transmission member includes a generally cup-shaped section having a cylindrical wall portion fitted on the end section of the first camshaft and fitted in the depression of the vane rotor.

15 Claims, 4 Drawing Sheets

VALVE TIMING CONTROL SYSTEM FOR INTERNAL COMBUSTION ENGINE

BACKGROUND OF THE INVENTION

This invention relates to improvements in a valve timing control system for hydraulically operating the opening and closing timings of intake and exhaust valves of an internal combustion engine, and more particularly to the valve timing control system of the type wherein a driving force is transmitted from a first camshaft to a second camshaft in the engine.

In recent years, a valve timing control system for an internal combustion engine of the type having two camshafts (first and second camshafts) on a cylinder head has been developed and disclosed in Japanese Patent Provisional Publication No. 9-280020. In this valve control system, the two camshafts are connected through a rotation control mechanism in a manner to be operated in timed relation to each other.

The valve timing control system disclosed in the Publication No. 9-280020 is arranged as follows: A vane rotor of the rotation control mechanism is installed together with a first driving force transmission member (sprocket or the like) to an end section of the first camshaft. A second driving force transmission member (gear or the like) is integrally fixed to a housing of the rotation control mechanism. The first driving force transmission member is driveably connected to a crankshaft, while the second driving force transmission member is drivingly connected to the second camshaft. Accordingly, the driving force input from the crankshaft to the first driving force transmission member is directly input to the first camshaft and further transmitted to the second camshaft through the rotation control mechanism and the second driving force transmission member.

In case of this valve timing control system, the vane rotor and the first driving force transmission member are formed with a central through-hole, and fitted on the first camshaft in such a manner that the first camshaft pierces the central through-hole, in which they are thrust against an engagement flange formed on the first camshaft. In other words, the engagement flange has been previously formed on the first camshaft at a position close to the end section of the first camshaft. A cam bolt is screwed into the first camshaft under a condition where the vane rotor and the first driving force transmission member are fitted on the end section of the first camshaft, so that the vane rotor and the first driving force transmission member are fastened and fixed between the head section of the cam bolt and the engagement flange.

However, drawbacks have been encountered in the conventional valve timing control system disclosed in the Publication No. 9-280020, in which the first camshaft must be integrally formed with the engagement flange against which the vane rotor and the first driving force transmission member are thrust to be fastened and fixed in position. This increases a production cost for the first camshaft.

SUMMARY OF THE INVENTION

It is an object of the present invention to provide an improved valve timing control system for an internal combustion engine, which can overcome drawbacks encountered in conventional valve timing control systems.

Another object of the present invention is to provide an improved valve timing control system for an internal combustion engine, in which a vane rotor of a rotation control mechanism and a driving force transmission member can be securely installed to a camshaft without inviting a rise in production cost and deformation of a cam bolt for fixing the vane rotor and the driving force transmission member to the camshaft.

A further object of the present invention is to provide an improved valve timing control system for an internal combustion engine, in which load applied to a vane rotor of a rotation control mechanism and a driving force transmission member is supported on the end section of a camshaft thereby preventing the load from being applied to a cam bolt.

An aspect of the present invention resides in a valve timing control system for an internal combustion engine. The valve timing control system comprises a rotation control mechanism comprising a housing, and a vane rotor which is rotatably disposed inside the housing and has at least one vane section. The vane section defines a first chamber and a second chamber which are located on opposite sides of the vane section, a hydraulic pressure being selectively supplied to and released from the first chamber and the second chamber so as to controllably accomplish a relative rotation of the vane rotor to the housing. The vane rotor is formed at its axially end section with a depression. A first camshaft is connected to the vane rotor by a cam bolt piercing the vane rotor along an axis of the vane rotor. A second camshaft is disposed parallel with the first camshaft. A first driving force transmission member is installed to the housing and connected to one of a crankshaft and the second camshaft. The housing of the rotation control mechanism has the first driving force transmission member. Additionally, a second driving force transmission member is installed to an end section of the first camshaft together with the vane rotor by the cam bolt and connected to the other of the crankshaft and the second camshaft. The second driving force transmission member comprises a generally cup-shaped section which has a cylindrical wall portion fitted on the end section of the first camshaft and fitted in the depression of the vane rotor. In the above arrangement, the vane rotor of the rotation control mechanism and the generally cup-shaped section of the second driving force transmission member are fixed together to the end section of the first camshaft upon tightening the cam bolt.

Another aspect of the present invention resides in a valve timing control system for an internal combustion engine. The valve timing control system comprises a rotation control mechanism comprising a casing, and a vane rotor which is rotatably disposed inside the housing. The vane rotor comprises a generally cylindrical body section, and at least one vane section integral with and radially extending from the cylindrical body section. The vane section defines a timing-advancing chamber and a timing-retarding chamber which are located on opposite sides of the vane section, the vane rotor making a relative rotation to the housing in a first direction for advancing a valve timing upon supply of hydraulic pressure into the timing-advancing chamber, the vane rotor making a relative rotation to the housing in a second direction for retarding the valve timing upon supply of hydraulic pressure into the timing-retarding chamber, the second direction being opposite to the first direction. The vane rotor is formed at its axially end section with a depression generally coaxial with the cylindrical body section. A change-over valve is provided and arranged such that a hydraulic pressure is selectively supplied through the change-over valve to the timing-advancing chamber and the timing-retarding chamber in accordance with an engine operating condition. A first camshaft is coaxially connected to the body section of the vane rotor by a cam bolt piercing the body section of the vane rotor along an axis of the vane rotor. A second camshaft is disposed parallel with the first camshaft. A first driving force transmission member is coaxially installed to the housing and connected to one of a crankshaft and the second camshaft. The housing of the rotation control mechanism has the first driving force transmission member. Additionally, a second driving force transmission member is coaxially installed to an end section of the first camshaft together with the vane rotor by the cam bolt and connected to the other of the crankshaft and the second camshaft. The second driving force transmission member comprises a generally cup-shaped section which comprises a cylindrical wall portion coaxial with the cylindrical body section of the vane rotor. The cylindrical wall portion is coaxially fitted on the end section of the first camshaft and has an end part fitted in the depression of the vane rotor of the rotation control mechanism. In the above arrangement, the vane rotor of the rotation control mechanism and the generally cup-shaped section of the second driving force transmission member are fixed together to the end section of the first camshaft upon tightening the cam bolt.

In the above valve timing control system according to the present invention, the second driving force transmission member is fitted and supported at its cup-shaped section on the end section of the camshaft. Additionally, the vane rotor is fitted and supported through the cup-shaped section of the second driving force transmission member on the end section of the camshaft. Accordingly, load applied to the vane rotor and the second driving force transmission member is supported on a fitting section at the end section of the camshaft though the vane rotor and the second driving force transmission member are fixed to the end section of the cam bolt under fastening of the cam bolt.

A further aspect of the present invention resides in a V-type internal combustion engine having first and second banks of cylinders. The engine comprises a first exhaust valve-side camshaft for driving exhaust valves, disposed in the first bank. A second exhaust valve-side camshaft is provided for driving exhaust valves, disposed in the second bank. A first intake valve-side camshaft is provided for driving intake valves, and is disposed in the first bank and located inside relative to the first exhaust valve-side camshaft, the first intake valve-side camshaft being parallel with the first exhaust valve-side camshaft. A second intake valve-side camshaft is provided for driving intake valves and disposed in the second bank and located inside relative to the second exhaust-side camshaft, the second intake valve-side camshaft being parallel with the second exhaust valve-side camshaft. A first rotation control mechanism is provided comprising a housing, and a vane rotor which is rotatably disposed inside the housing and has at least one vane section. The vane section defines a first chamber and a second chamber which are located on opposite sides of the vane section, hydraulic pressure being selectively supplied to and released from the first chamber and the second chamber so as to controllably accomplish a relative rotation of the vane rotor to the housing. The vane rotor is formed at its axially end section with a depression. The vane rotor is connected to the first exhaust valve-side camshaft by a cam bolt piercing the vane rotor along an axis of the vane rotor. A first driving force transmission member is connected to one of a crankshaft and the first intake valve-side camshaft. The housing of the first rotation control mechanism has the first driving force transmission member. A second driving force transmission member is installed to an end section of the first exhaust valve-side camshaft together with the vane rotor by the cam bolt and connected to the other of the crankshaft and the first intake valve-side camshaft. The second driving force transmission member comprises a generally cup-shaped section which has a cylindrical wall portion fitted on the end section of the first exhaust valve-side camshaft and fitted in the depression of the vane rotor, wherein the vane rotor of the first rotation control mechanism and the generally cup-shaped section of the second driving force transmission member are fixed together to the end section of the first exhaust valve-side camshaft upon tightening the cam bolt.

Additionally, the V-type internal combustion engine comprises a second rotation control mechanism which comprises a housing, and a vane rotor which is rotatably disposed inside the housing and has at least one vane section. The vane section defines a first chamber and a second chamber which are located on opposite sides of the vane section, hydraulic pressure being selectively supplied to and released from the first chamber and the second chamber so as to controllably accomplish a relative rotation of the vane rotor to the housing. The vane rotor is formed at its axially end section with a depression. The vane rotor is connected to the second exhaust valve-side camshaft by a cam bolt piercing the vane rotor along an axis of the vane rotor. A third driving force transmission member is connected to one of the crankshaft and the second intake valve-side camshaft. The housing of the second rotation control mechanism has the third driving force transmission member. Additionally, a fourth driving force transmission member is installed to an end section of the second exhaust valve-side camshaft together with the vane rotor by the cam bolt and connected to the other of the crankshaft and the second intake valve-side camshaft. The fourth driving force transmission member comprises a generally cup-shaped section which has a cylindrical wall portion fitted on the end section of the second exhaust valve-side camshaft and fitted in the depression of the vane rotor, wherein the vane rotor of the second rotation control mechanism and the generally cup-shaped section of the fourth driving force transmission member are fixed together to the end section of the second exhaust valve-side camshaft upon tightening the cam bolt.

The other objects and features of this invention will become understood from the following description with reference to the accompanying drawings.

DETAILED DESCRIPTION OF THE INVENTION

Figure 2:
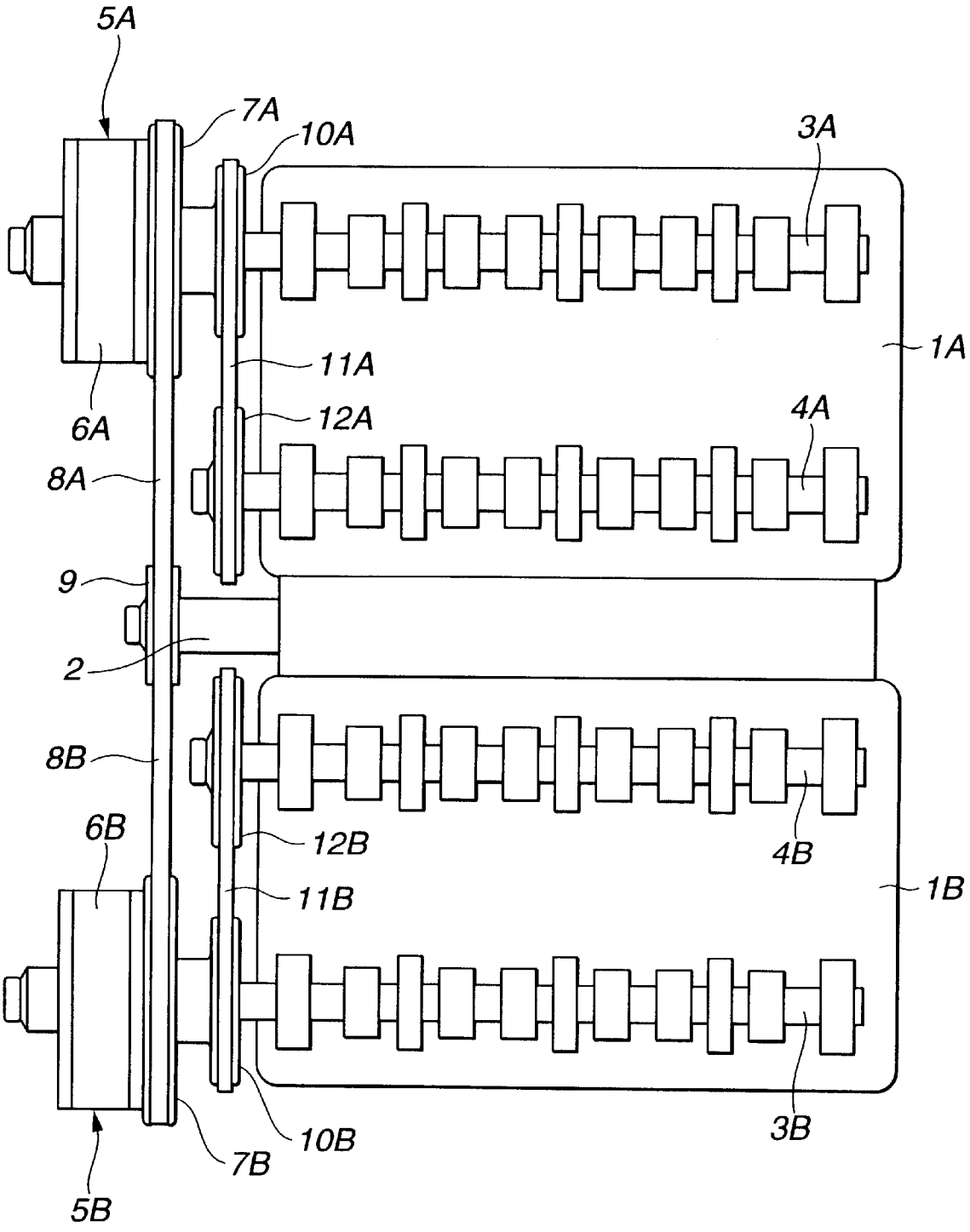
FIG. 2 is a schematic plan view of an internal combustion engine provided with the valve timing control system of FIG. 1.

Referring now to FIG. 2 of the drawings, an internal combustion engine is illustrated incorporating an embodiment of a valve timing control system according to the present invention. The engine is of a so-called V-type and includes a two banks of cylinders. The two banks respectively have cylinder heads 1A, 1B. A crankshaft 2 is provided to be driven by pistons (not shown) disposed in the two banks. Cylinder heads 1A, 1B are respectively provided with exhaust valve-side camshafts 3A, 3B serving as first camshafts, and respectively provided with intake valve-side camshafts 4A, 4B serving as second camshafts. Exhaust and intake valve-side camshafts 3A, 4A are disposed parallel with each other, and exhaust and intake-side camshafts 3B, 4B are disposed parallel with each other.

Rotation control mechanisms 5A, 5B are respectively provided to end sections of exhaust valve-side camshaft 3A, 4A in banks 1A, 1B. Each rotation control mechanism 5A, 5B includes a housing 6A, 6B which is integrally formed with a primary sprocket (first driving force transmission member) 7A, 7B. Primary sprocket 7A, 7B is connected through a timing chain 8A, 8B to a crank sprocket 9 mounted on a crankshaft 2 in such a manner as to be driven by crank sprocket 9. Additionally, secondary sprockets (second driving force transmission members) 10A, 10B are respectively provided to the end sections of exhaust valve-side camshafts 3A, 3B. Secondary sprockets 10A, 10B are respectively drivingly connected through chains 11A, 11B to cam sprockets 12A, 12B which are respectively provided to end sections of intake valve-side camshafts 4A, 4B. Accordingly, in the internal combustion engine, rotation of crankshaft 2 is input to the exhaust valve-side camshafts 3A, 3B through primary sprockets 7A, 7B and the rotation control mechanisms 5A, 5B. Rotations of exhaust valve-side camshafts 3A, 3B are input to intake valve-side camshafts 4A, 4B through secondary sprockets 10A, 10B.

Figure 3:
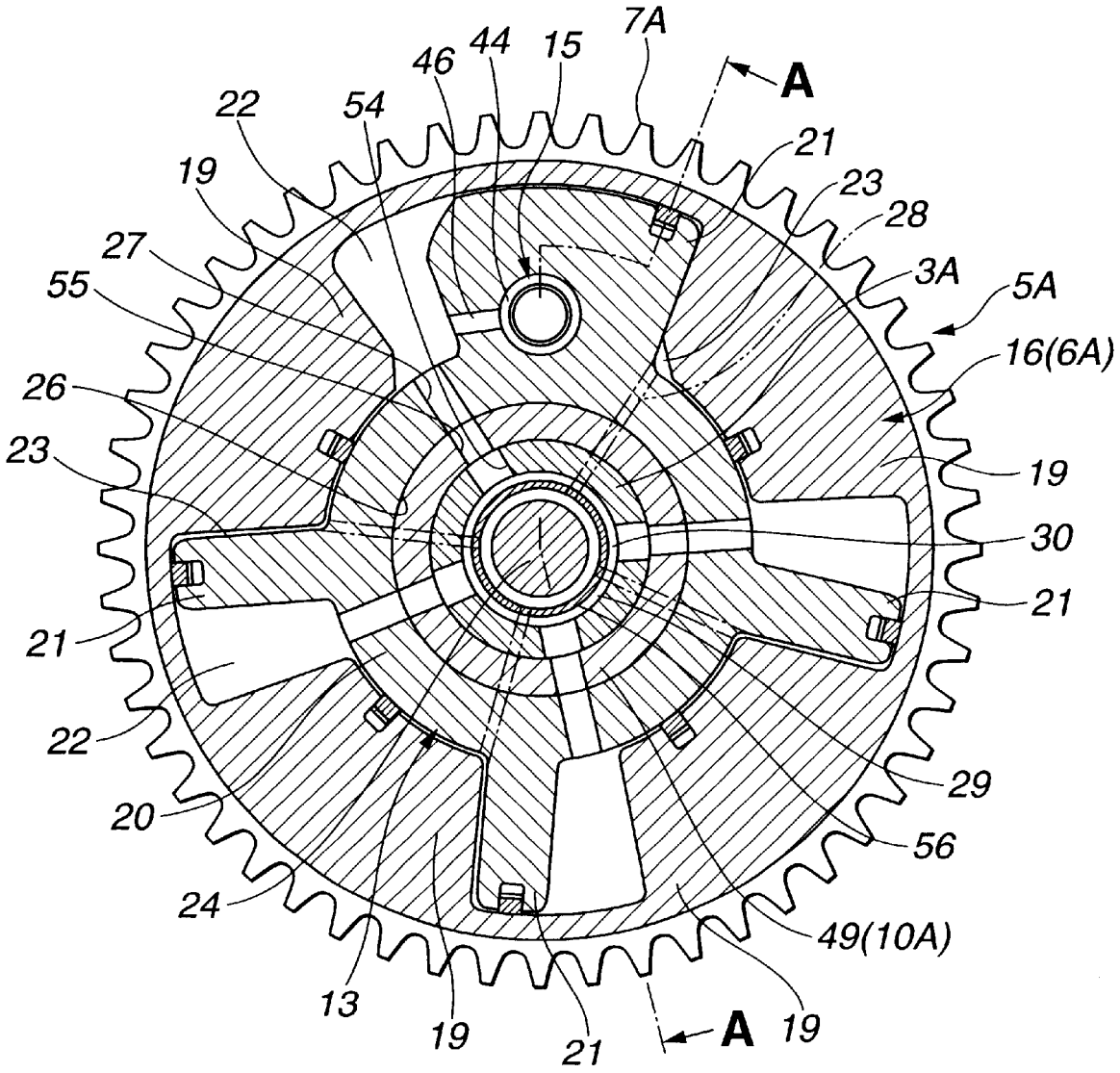
FIG. 3 is a vertical section view taken in the direction of the arrows substantially along the line B—B of FIG. 1.

Hereinafter, the valve timing control system will be discussed in detail with reference to FIGS. 1 and 3. Banks 1A, 1B are basically the same in construction as each other, and therefore explanation will be made only on the side of one bank 1A located on the above-side of FIG. 2.

Rotation control mechanism 5A of the valve timing control system includes housing 6A which is integrally formed with primary sprocket 7A. A vane rotor 13 is fixedly fitted on the end section of exhaust valve-side camshaft 3A and rotatably accommodated inside housing 6A. A hydraulic pressure supply-release means or device 14 is provided to rotate vane rotor 13 in right and reverse directions relative to housing 6A in accordance with operating conditions of the engine. A lock mechanism 15 is provided to restrict a rotational fluctuation of vane rotor 13 due to torque reaction applied from exhaust valves (not shown) to exhaust valve-side camshaft 3A.

Housing 6A includes a generally cylindrical housing main body 16. Generally disc-shaped front and rear covers 17, 18 are respectively fixedly connected to the front and rear end faces of housing main body 16. As shown in FIG. 3, housing main body 16 is formed at its inner peripheral surface with four partition walls 19 each of which is generally trapezoidal in section. Each partition wall 19 projects radially inwardly from the inner peripheral surface of housing main body 16. Primary sprocket 7A is formed integral with the outer periphery of rear cover 18. Otherwise, primary sprocket 7A may be formed integral with housing main body 16.

Vane rotor 13 has a generally cylindrical body section 20 which is integrally provided with four vane sections 21 which project radially outwardly from the outer peripheral surface of cylindrical body section 20. Cylindrical body section 20 is disposed coaxial in housing 6A and rotatable around the axis of housing 6A. Each vane section 21 is movably disposed between adjacent partition walls 19, 19. A timing-advancing chamber (first chamber) 22 is formed between one side surface of each vane section 21 of vane rotor 13 and the side surface of partition wall 19 facing the one side surface of vane section 21, while a timing-retarding chamber (second chamber) 23 is formed between the other side surface of the vane section and the side surface of the other partition wall 19 facing the other side surface of the vane section. Timing-advancing chamber 22 and timing-retarding chamber 23 are separate from each other, maintaining a liquid-tight seal.

Cylindrical body section 20 of vane rotor 13 is formed with a central bore 25 whose axis is aligned with the axis of housing 6A. A cam bolt 24 is disposed in central bore 25 in such a manner that its axis is aligned with the axis of housing 6A. Cylindrical body section 20 is formed at its rear surface with a circular depression 26 which is coaxial with central bore 25. Depression 26 is defined by an axially extending cylindrical inner wall surface (not identified) of cylindrical body section 20 which surface is coaxial with central bore 25. Cylindrical body section 20 is formed with first radial (radially extending) holes 27 and second radial (radially extending) holes 28. Each first radial hole 27 establishes communication between each timing-advancing chamber 22 and depression 26. Each second radial hole 28 establishes communication between each timing-retarding chamber 23 and central bore 25. In a condition in which vane rotor 13 is installed to the end section of exhaust valve-side camshaft 3A, each first radial hole 27 and each second radial hole 28 are respectively brought into communication with a first supply-release hole or passage 29 and a second supply-release hole or passage 30 (discussed in detail after) formed in camshaft 3A.

Hydraulic pressure supply-release device 14 has a first hydraulic pressure passage 32 and a second hydraulic pressure passage 31. The first hydraulic pressure passage 32 is connected to first supply-release hole 29 so as to supply hydraulic pressure to or release hydraulic pressure from timing-advancing chamber 22. The second hydraulic pressure passage 31 is connected to second supply-release hole 30 so as to supply hydraulic pressure or release hydraulic pressure from timing-retarding chamber 23. First and second hydraulic pressure passages 31, 32 are respectively connected to a supply passage 33 and a drain passage 34 through an electromagnetic change-over valve 35. Supply passage 33 is provided with an oil pump 37 which pressurizes oil or hydraulic fluid inside an oil pan 36. An end section of drain passage 34 is connected to the inside of oil pan 36. Electromagnetic change-over valve 35 is controlled by a controller (electronic control unit) 38 which is adapted to generate a variety of signals to be input to the valve 35, in accordance with engine speed, engine load, coolant temperature and the like of the engine.

Lock mechanism 15 includes a lock pin 40 which is axially movably accommodated in a cylindrical hole 39 which is axially formed in one vane section 21 of vane rotor 13. A spring 41 is accommodated in the cylindrical hole 39 so as to bias lock pin 40 in a direction of front cover 17, in which one (front) end of spring 41 is in contact with lock pin. The other (rear) end of spring 41 is in contact with a spring supporting pin 42 disposed in cylindrical hole 39. A lock hole 43 is formed at the inside surface of front cover 17. The tip end section of lock pin 40 is brought into fit with lock hole 43 when vane rotor 13 is displaced to the maximum onto a timing-advancing side (where the valve timing is advanced) relative to housing 6A.

Cylindrical hole 39 of vane rotor 13 includes a small-diameter section in which the main body (front-side) section of rock pin 40 is slidably disposed, and a large-diameter section in which an annular flange portion 45 of rock pin 40 is slidably disposed. The small-diameter section is located close to the side of front cover 17. The annular flange portion 45 is formed at the outer periphery of the base (rear) section of rock pin 40, and faces an radially extending annular wall surface (of vane section 21) connecting a wall surface defining the large-diameter section and a wall surface defining the small-diameter section, so that an annular space 44 is defined between annular flange portion 45 and the annular wall surface. Annular space 44 is communicated with timing-advancing chamber 22 through a communication passage 46 (See FIG. 3) formed in vane section 21 as shown in FIG. 3. A lock release passage 47 is connected to the bottom portion of the lock hole 43 on the side of front cover 17, and is in communication with timing-retarding chamber 23, so that hydraulic pressure within timing-retarding chamber 23 acts on the tip end portion of lock pin 40 when rock pin 40 is in fit with lock hole 43. In this embodiment, the pressure-receiving area of flange section 45 to which hydraulic pressure within timing-advancing chamber 22 acts is set to be equal to the pressure-receiving area of the tip end portion of lock pin 40 on which hydraulic pressure within timing-retarding chamber 23 acts. It will be understood that a chamber (not identified) located at the rear side of the lock pin 40 and forming part of cylindrical hole 39 is maintained at the atmospheric pressure through a passage (not shown).

This lock mechanism 15 is adapted to mechanically lock a relative rotation of vane rotor 13 to housing 6A in a condition in which vane rotator is rotated to the maximum onto the timing-advancing side when the pressure of hydraulic fluid applied to vane sections 21 of vane rotor 13 has not sufficiently risen, for example, at engine starting. When the pressure of hydraulic fluid rises from the above condition so as to introduce high pressure hydraulic fluid into lock hole 43, lock pin 40 disengages from lock hole 43 thereby allowing rotation of vane rotor 13.

When vane rotor 13 is controllably rotated from a timing-retarding side (where the valve timing is retarded) to the timing-advancing side, a high pressure of hydraulic fluid cannot act on the tip end section of lock pin 40 because the pressure within timing-retarding chamber 23 is low, so that the tip end section of lock pin 40 is to be pressed on front cover 17 under the biasing force of spring 41. However, at this time, a high pressure of hydraulic fluid within timing-advancing chamber 22 acts on flange portion 45 of lock pin 40, and therefore lock pin 40 is kept at its rearward-most position under this high pressure. Accordingly, the rotation of vane rotor 13 onto the timing-advancing side cannot be impeded by lock pin 40.

Figure 1:
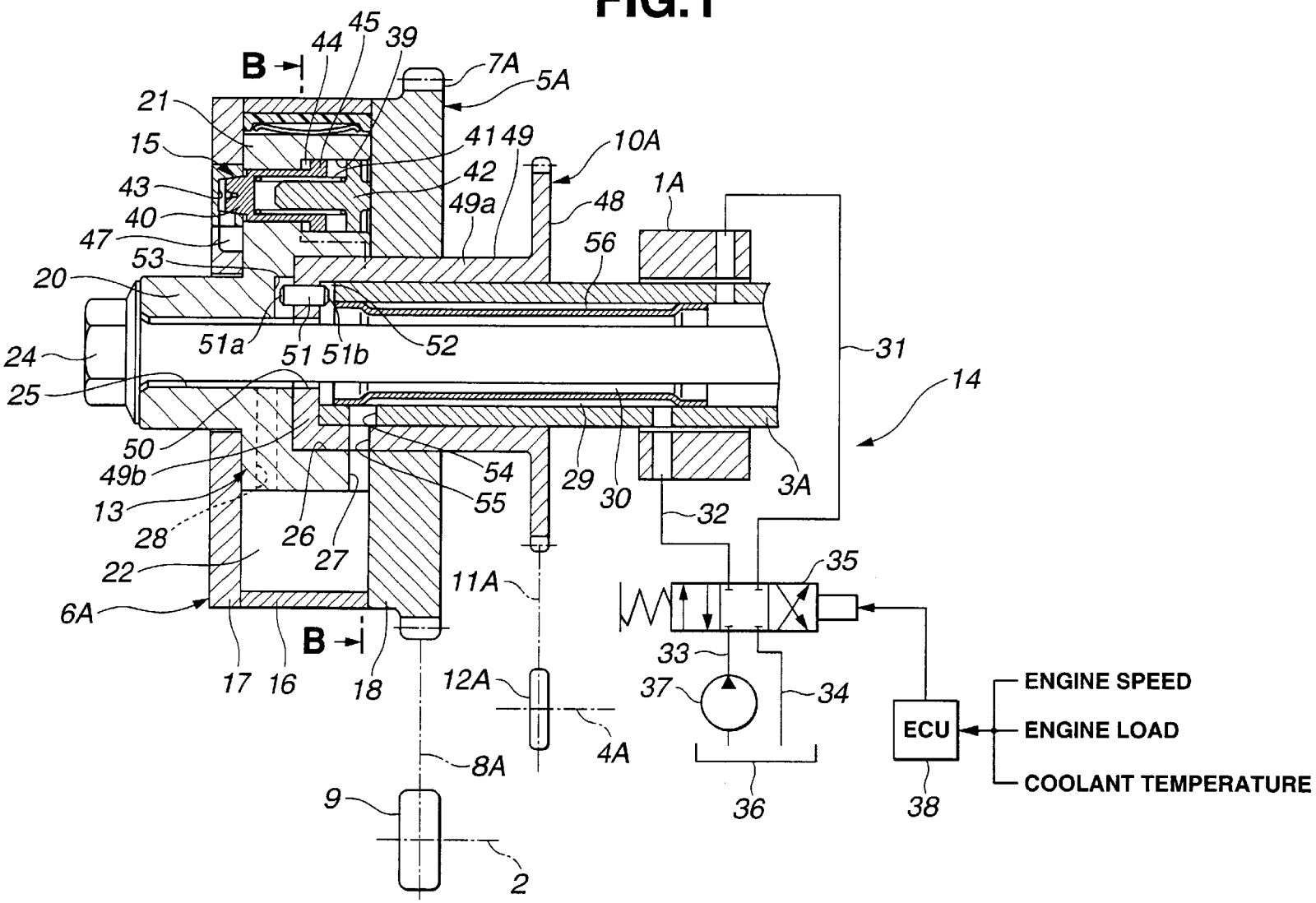
FIG. 1 is a longitudinal sectional view of an embodiment of a valve timing control system according to the present invention, taken in the direction of the arrows substantially along the line A—A of FIG. 3.
Figure 4:
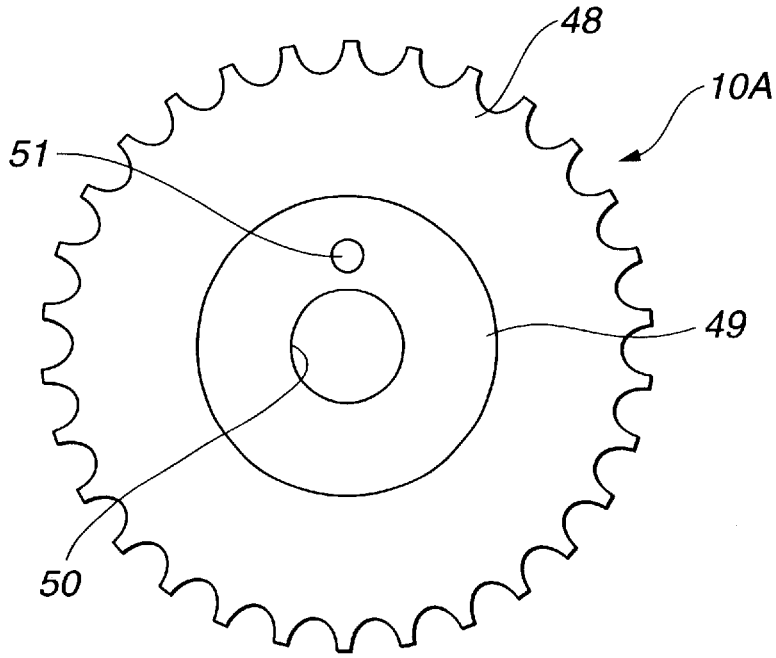
FIG. 4 is a front view of a second driving force transmission member (secondary sprocket) used in the valve timing control system of FIG. 1.
Figure 5:
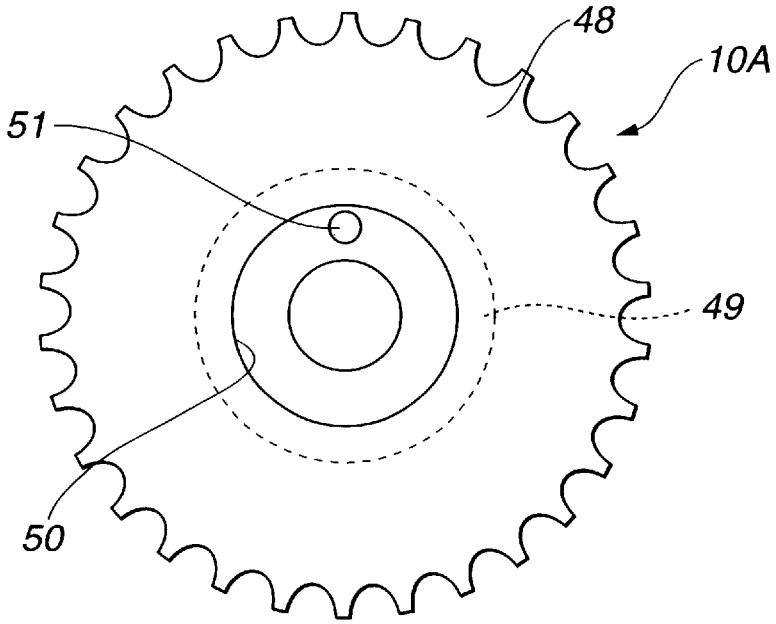
FIG. 5 is a back-side view of the second driving force transmission member of FIG. 4.

As shown in FIGS. 1, 4 and 5, secondary sprocket 10A is not simply disc-shaped and includes an annular main body section 48 and a generally cup-shaped section 49 integral with main body section 48. Main body section 48 is formed at its outer peripheral portion with sprocket teeth. Cup-shaped section 49 includes a cylindrical wall portion 49*a* whose rear end part is integral with an inner peripheral portion of main body section 48 in such a manner that the inner peripheral surface of cylindrical wall portion 49*a* is flush with the inner peripheral surface of main body section 48. A bottom wall portion 49*b* is integral with the front end part of cylindrical wall portion 49*a*. The end section of exhaust valve-side camshaft 3A is fitted within cylindrical wall portion 49*a* of cup-shaped section 49. The front end section of cylindrical wall portion 49*b* and the outer peripheral portion of bottom wall portion 49*b* of cup-shaped section 49 are fitted in depression 26 of vane rotor 13 in such a manner as to be in fitting contact with the cylindrical inner wall surface of cylindrical body section 20 of vane rotor 13. Bottom wall portion 49*b* is formed at its central part with a bolt insertion hole 50 in which the cam bolt 24 is to be disposed. Additionally, bottom wall portion 49*b* is formed with a locating pin hole (no numeral) located radially outward of bolt insertion hole 50, in which a locating pin 51 is press-fitted in the locating pin hole in such a manner that the locating pin projects forward and rearward of bottom wall portion 49*b* thereby to form front and rear projected end portions 51*a*, 51*b*.

Exhaust valve-side camshaft 3A is formed at its front end face with a radial (radially extending) groove 52 serving as an engaged portion. Another radial groove 53 serving as another engaged portion is formed at a surface of vane rotor 13 which surface defines the bottom of depression 26. Front and rear projected end portions 51*a*, 51*b* of locating pin 51 are respectively fitted in radial grooves 53, 52. Radial grooves 52, 53 are formed to radially extend, thereby allowing errors of locating pin 51 in radial installation position and angle. Additionally, each radial groove 52, 53 is formed in such a manner that locating pin 51 is axially loosely fitted in radial groove 52, 53 with a clearance, thereby allowing an error of locating pin 51 in an axial direction.

Secondary sprocket 10A is fitted on exhaust valve-side camshaft 3A and to vane rotor 13 upon being positioned by locating pin 51. Further, second sprocket 10A is fixed to exhaust valve-side camshaft 3A together with vane rotor 13 by fastening cam bolt 24. Cam bolt 24 is screwed in exhaust valve-side camshaft 3A through the central hole 25 of vane rotor 13 and bolt insertion hole 50 of secondary sprocket 10A, in which an annular clearance is formed between the peripheral surface of cam bolt 24 and each of the inner peripheral surface of cylindrical body section 20 of vane rotor 13 and the inner peripheral surface of bottom wall portion 49*b* of secondary sprocket 10A. This annular clearance serves as a passage for establishing communication between the second radial holes 28 of vane rotor 13 and second supply-release hole 30 of exhaust valve-side camshaft 3A.

Furthermore, the end section of exhaust valve-side camshaft 3A is formed with through-holes 54. Cylindrical wall section 49*a* of secondary sprocket 10A is formed with through-holes 55 which are in communication with through-hole 54 of camshaft 3A. Each first radial hole 27 of vane rotor 13 is communicated with the first supply-release hole 29 of exhaust valve-side camshaft 3A through through-holes 54, 55. The end section of exhaust valve-side camshaft 3A is formed cylindrical thereby forming a cylindrical end section. A tube 56 whose opposite end sections are enlarged in diameter is fixed inside the cylindrical end section of camshaft 3A. The tube 56 divides an annular space formed between the inner peripheral surface of the cylindrical end section of camshaft 3A and the outer peripheral surface of the cam bolt 24 into an outer annular space corresponding to first supply-release hole 29 and an inner annular space corresponding to second supply-release hole 30.

Next, operation of the above valve timing control system will be discussed hereinafter.

At engine starting of the internal combustion engine, lock mechanism 15 mechanically locks vane rotor 13 of rotation control mechanism 5A and housing 6A under a condition where vane rotor 13 has rotated onto the timing-advancing side relative to housing 6A. In this condition, rotational force of crankshaft 2 is transmitted to exhaust valve-side camshaft 3A through primary sprocket 7A and rotation control mechanism 5A. Accordingly, at this time, exhaust valve-side camshaft 3A drives exhaust valves (not shown) to open and close at advanced timings which are advanced relative to a standard timing. Further, rotation of exhaust valve-side camshaft 3A is transmitted to intake valve-side camshaft 4A through secondary sprocket 10A. It will be understood that, at this time, intake valve-side camshaft 4A is rotated in the same phase as or in timed relation to exhaust valve-side camshaft 3A.

After the engine is started under the above condition, when timing-retarding chambers 23 are brought into communication with supply passage 33 while timing-advancing chambers 22 are simultaneously brought into communication with drain passage 34, high pressure of hydraulic oil to be introduced into timing-retarding chamber 23 is applied to the tip (front) end of lock pin 40, and therefore lock pin 40 is moved rearward under the high pressure of hydraulic oil. This releases the mechanical lock between housing 6A and vane rotor 13 under the action of lock mechanism 15, so that vane rotor 13 is rotated onto the timing-retarding side relative to housing 6A upon vane rotor receiving a pressure within timing-retarding chambers 23. As a result, exhaust-valve side camshaft 3A drives exhaust valves (not shown) to open and close at retarded timings which are retarded relative to the standard timing. Thus, rotation of exhaust valve-side camshaft 3A is transmitted to intake valve-side camshaft 4A through secondary sprocket 10A.

As discussed above, in the valve timing control system, rotation of exhaust valve-side camshaft 3A is transmitted to intake valve-side camshaft 4A through secondary sprocket 10A. Additionally, cylindrical wall portion 49*a* of secondary sprocket 10A is fitted on the end section of exhaust valve-side camshaft 3A and fitted in depression 26 of vane rotor 13. Hence, the mass of secondary sprocket 10A and the rotation control mechanism 5A and other loads and the like to be applied thereto hardly act onto cam bolt 24, and therefore they are directly supported on the outer peripheral surface of exhaust valve-side camshaft 3A. Thus, according to the valve timing control system, there is no fear of deformation of cam bolt 24 even upon a long time use, thereby preventing occurrence of problems of increased inertia force of rotation control mechanism 5A due to deformation of cam bolt 24 and of generation of vibrational noises due to the increased inertia force.

In case of this valve timing control system, causing vane rotor 13 and secondary sprocket 10A to be fitted and supported on exhaust valve-side camshaft 3A is accomplished only by forming cup-shaped section 49 integral with secondary sprocket 10A which is inherently plate-shaped, without using a measure of forming an engagement flange and the like on the outer peripheral surface of axially lengthy exhaust valve-side camshaft 3A. This reduces production cost of the valve timing control system.

Locating secondary sprocket 10A relative to exhaust valve-side camshaft 3A and vane rotor 13 is accomplished by incorporating a locating member such as locating pin 51 shown in FIG. 1 or a key. This makes unnecessary special jigs or the like for locating the three members 10A, 3A, 13, thereby improving a production efficiency of the valve timing control system. During such locating, particularly by fixing the locating member (locating pin) to one of the three members as shown and described in this embodiment, it is sufficient for the purpose of assembly of the valve timing control system, that the locating member is inserted into the engaged sections of the other two members, thereby improving the production efficiency of the valve timing control system.

In this embodiment, locating pin 51 is fixed to bottom wall portion 49*b* of cup-shaped section 49 of secondary sprocket 10A. In this case, locating pin 51 is supported at its axially central part on secondary sprocket 10 and therefore is prevented from taking an overhung type structure, so that the installation position and angle of locating pin 51 cannot easily shift during assembly of the valve timing control system. Accordingly, assembly operation for the above three members can be achieved more easily and more accurately.

Each engaged section with which projected end portion 51*a*, 51*b* of locating pin 51 engages may have a cross-sectional shape of complete round corresponding to the cross-sectional shape of locating pin 51. However, in this embodiment, radial (radially extending) grooves 52, 53 are employed as the engaged sections. In this case, the errors of locating pin 51 in radial installation position and angle can be absorbed, thereby making it unnecessary a severe dimensional control in radial direction during installation of locating pin 51 and/or formation of the engaged section. This makes it possible to produce the valve timing control system at a low production cost. Additionally, in the embodiment, radial grooves 52, 53 have such a depth (or axial dimension) that locating pin 51 is engaged in the radial grooves with a clearance. In other words, each of the radial grooves 52, 53 have a radially extending surface (not identified) defining radial groove 52, 53, in which axially extending locating pin 51 (or projected end portion 51*a*, 51*b*) is axially separate from the radially extending surface with the clearance. This makes unnecessary a severe dimensional control also in axial direction, thereby achieving a further lowing in production cost.

While sprockets 7A, 10A have been shown and described as being used respectively as the first driving force transmission member to be installed to housing 6A and the second driving force transmission member to be installed to camshaft 3A in the embodiment, it will be understood that the first and second driving force transmission members are not limited to sprockets and therefore may be pulleys for transmitting a driving force in cooperation with belts, or gears for transmitting the driving force upon direct engagement with other gears.

Although the first driving force transmission member (sprocket 7A) and the second driving force transmission member (sprocket 10A) have been shown and described as being respectively connected to crankshaft 2 and second camshaft 4A, it will be understood that the first driving force transmission member (sprocket 7A) to be installed to housing 6A may be conversely connected to the second camshaft 4A, while the second driving force transmission member (sprocket 10A) to be installed to first camshaft 3A may be conversely connected to crankshaft 2.

Turning back to the conventional valve timing control system disclosed in the Publication No. 9-280020 discussed in "Background of the Invention", in which the drawback of increasing the production cost for the first camshaft has been encountered. As a measure for the above drawback, it may be proposed to fix the vane rotor an the driving force transmission member to the camshaft by the cam bolt under a condition where the end face of the vane rotor or the driving force transmission member is brought into contact with the end face of the cam the camshaft. However, in this case, the cam bolt must support whole the rotation control mechanism including the housing, and therefore a high load is applied to the cam bolt thereby deforming the cam bolt. In the event that the cam bolt is deformed, an inertia force of the rotation control mechanism applied to the camshaft becomes high thereby causing generation of vibrational noise and lowering of durability of a bearing section for the camshaft. Such a problem may be solved to a certain extent by thickening the cam bolt. However, there is a limit for thickening the cam bolt. If the cam bolt is made too thick, passages for hydraulic pressure cannot be formed in the first camshaft and in the vane rotor. Thus, such a measure is insufficient to prevent deformation of the cam bolt, and therefore further improvements have been desired. It will be understood that such further improvements can be achieved by the present invention.

As appreciated from the above, according to the present invention, the cylindrical wall portion of the generally cup-shaped section of the second driving force transmission member is fitted on the end section of the camshaft and in the depression of the vane rotor, and therefore both the vane rotor and the second driving force transmission member can be fitted and supported on the end section of the first camshaft. Consequently, both the vane rotor and the second driving force transmission member can be securely installed to the first camshaft under a condition where the load of the vane rotor and the second driving force transmission member is hardly applied to the cam bolt. This can effectively avoid difficulties such as generation of vibrational noise due to deformation of the cam bolt, lowering in durability of a bearing section for the camshaft, and the like. Additionally, the first camshaft is not required to be provided at its outer periphery with an engagement flange or the like, thereby preventing a rise in production cost of the first camshaft.

The entire contents of Japanese Patent Application No. 2000-320488, filed Oct. 20, 2000, are incorporated herein by reference.

What is claimed is:

1. A valve timing control system for an internal combustion engine, comprising:

a rotation control mechanism comprising a housing, and a vane rotor which is rotatably disposed inside the housing and has at least one vane section, the vane section defining a first chamber and a second chamber which are located on opposite sides of the vane section, a hydraulic pressure being selectively supplied to and released from the first chamber and the second chamber to controllably accomplish a relative rotation of the vane rotor to the housing, the vane rotor being formed at its axially end section with a depression;

a first camshaft connected to the vane rotor by a cam bolt piercing the vane rotor along an axis of the vane rotor;

a second camshaft disposed parallel with said first camshaft;

a first driving force transmission member connected to one of a crankshaft and said second camshaft, the housing of said rotation control mechanism having said first driving force transmission member; and a second driving force transmission member installed to an end section of said first camshaft together with the vane rotor by the cam bolt and connected to the other of the crankshaft and said second camshaft, said second driving force transmission member comprising a generally cup-shaped section which has a cylindrical wall portion fitted on the end section of said first camshaft and fitted in the depression of the vane rotor, wherein the vane rotor of said rotation control mechanism and the generally cup-shaped section of said second driving force transmission member are fixed together to the end section of said first camshaft upon tightening the cam bolt.

2. A valve timing control system as claimed in claim 1, further comprising a locating member disposed between the vane rotor and said second driving force transmission member and between said second driving force transmission member and said first camshaft.

3. A valve timing control system as claimed in claim 2, wherein said locating member is fixed to one of the vane rotor, said second driving force transmission member and said first camshaft, wherein two of the vane rotor, said second driving force transmission member and said first camshaft are formed respectively with first and second engaged sections to which said locating member engages, the two being other than the one.

4. A valve timing control system as claimed in claim 3, wherein said locating member is fixed to the generally cup-shaped section of said second driving force transmission member, wherein the vane rotor and said first camshaft are formed respectively with first and second engaged sections to which said locating member engages.

5. A valve timing control system as claimed in claim 4, wherein said locating member is an axially extending locating pin, wherein each of said engaged sections has a radially extending groove to which said locating pin engages.

6. A valve timing control system as claimed in claim 5, wherein each of said engaged sections has a radially extending surface defining the radially extending groove, said axially extending locating pin being axially separate from the radially extending surface with a clearance.

7. A valve timing control system as claimed in claim 1, wherein said first camshaft is an exhaust valve-side camshaft for driving exhaust valves, and said second camshaft is an intake valve-side camshaft for driving intake valves.

8. A valve timing control system as claimed in claim 1, wherein said first camshaft has a cylindrical end section inside which a tube is fixed, the tube having opposite end sections which are enlarged in diameter, the tube being located radially outside of the cam bolt to define a first passage in communication with the first chamber of said rotation control mechanism and a second passage in communication with the second chamber of said rotation control mechanism.

9. A valve timing control system as claimed in claim 8, wherein the generally cup-shaped section of said second driving force transmission member has a portion defining a through-hole in communication with the first passage defined between the tube and an inner peripheral surface of the cylindrical end section of said first camshaft, the first passage being in communication with one of the first and second chambers of said rotation control mechanism.

10. A valve timing control system as claimed in claim 9, wherein the first passage defined between the tube and the inner peripheral surface of the cylindrical end section of said first camshaft is in communication with the first chamber of said rotation control mechanism, the first chamber being a timing-advancing chamber which is to be supplied with hydraulic pressure to advance a valve timing.

11. A valve timing control system as claimed in claim 8, wherein the cam bolt is fixed in a condition of being inserted in a central bore formed in the vane rotor and a bolt insertion hole formed at a bottom wall portion of the generally cup-shaped section of said second driving force transmission member, wherein a first clearance is formed between an inner peripheral surface of the vane rotor defining the central bore and an outer peripheral surface of the cam bolt, and a second clearance is formed between an inner peripheral surface of the bottom wall portion defining the bolt insertion hole and the outer peripheral surface of the cam bolt, the second passage defined by an inner peripheral surface of the tube being communicated through the first and second clearances with one of the first and second chambers of said rotation control mechanism.

12. A valve timing control system as claimed in claim 11, wherein the second passage defined by the inner peripheral surface of the tube is in communication with the second chamber of said rotation control mechanism, the second chamber being a timing-retarding chamber which is supplied with hydraulic pressure to retard a valve timing.

13. A valve timing control system as claimed in claim 1, wherein the depression is defined by a cylindrical inner wall surface of the vane rotor, the cylindrical inner wall surface being coaxial with the vane rotor, wherein the cylindrical inner wall surface is in fitting contact with the cylindrical wall portion of the generally cup-shaped section of said second driving force transmission member.

14. A valve timing control system for an internal combustion engine, comprising:

a rotation control mechanism comprising a casing, and a vane rotor which is rotatably disposed inside the housing and comprises a generally cylindrical body section, and at least one vane section integral with and radially extending from the cylindrical body section, the vane section defining a timing-advancing chamber and a timing-retarding chamber which are located on opposite sides of the vane section, the vane rotor making a relative rotation to the housing in a first direction for advancing a valve timing upon supply of hydraulic pressure into the timing-advancing chamber, the vane rotor making a relative rotation to the housing in a second direction for retarding the valve timing upon supply of hydraulic pressure into the timing-retarding chamber, the second direction being opposite to the first direction, the vane rotor being formed at its axially end section with a depression generally coaxial with the cylindrical body section;

a change-over valve through which hydraulic pressure is selectively supplied to the timing-advancing chamber and the timing-retarding chamber in accordance with an engine operating condition;

a first camshaft coaxially connected to the body section of the vane rotor by a cam bolt piercing the body section of the vane rotor along an axis of the vane rotor;

a second camshaft disposed parallel with said first camshaft;

a first driving force transmission member connected to one of a crankshaft and said second camshaft, the housing of said rotation control mechanism coaxially having said first driving force transmission member; and a second driving force transmission member coaxially installed to an end section of the first camshaft together with the vane rotor by the cam bolt and connected to the other of the crankshaft and said second camshaft, said second driving force transmission member comprising a generally cup-shaped section which comprises a cylindrical wall portion coaxial with the cylindrical body section of the vane rotor, the cylindrical wall portion being coaxially fitted on the end section of said first camshaft and having an end part fitted in the depression of the vane rotor of said rotation control mechanism, wherein the vane rotor of said rotation control mechanism and the generally cup-shaped section of said second driving force transmission member are fixed together to the end section of said first camshaft upon tightening the cam bolt.

15. A V-type internal combustion engine having first and second banks of cylinders, comprising:

a first exhaust valve-side camshaft for driving exhaust valves, disposed in the first bank;

a second exhaust valve-side camshaft for driving exhaust valves, disposed in the second bank;

a first intake valve-side camshaft for driving intake valves, disposed in the first bank and located inside relative to said first exhaust valve-side camshaft, said first intake valve-side camshaft being parallel with said first exhaust valve-side camshaft;

a second intake valve-side camshaft for driving intake valves, disposed in the second bank and located inside relative to said second exhaust-side camshaft, said second intake valve-side camshaft being parallel with said second exhaust valve-side camshaft;

a first rotation control mechanism comprising a housing, and a vane rotor which is rotatably disposed inside the housing and has at least one vane section, the vane section defining a first chamber and a second chamber which are located on opposite sides of the vane section, hydraulic pressure being selectively supplied to and released from the first chamber and the second chamber to controllably accomplish a relative rotation of the vane rotor to the housing, the vane rotor being formed at its axially end section with a depression, the vane rotor being connected to said first exhaust valve-side camshaft by a cam bolt piercing the vane rotor along an axis of the vane rotor;

a first driving force transmission member connected to one of a crankshaft and said first intake valve-side camshaft, the housing of said first rotation control mechanism having said first driving force transmission member;

a second driving force transmission member installed to an end section of said first exhaust valve-side camshaft together with the vane rotor by the cam bolt and connected to the other of the crankshaft and said first intake valve-side camshaft, said second driving force transmission member comprising a generally cup-shaped section which has a cylindrical wall portion fitted on the end section of said first exhaust valve-side camshaft and fitted in the depression of the vane rotor, wherein the vane rotor of said first rotation control mechanism and the generally cup-shaped section of said second driving force transmission member are fixed together to the end section of said first exhaust valve-side camshaft upon tightening the cam bolt;

a second rotation control mechanism comprising a housing, and a vane rotor which is rotatably disposed inside the housing and has at least one vane section, the vane section defining a first chamber and a second chamber which are located on opposite sides of the vane section, hydraulic pressure being selectively supplied to and released from the first chamber and the second chamber to controllably accomplish a relative rotation of the vane rotor to the housing, the vane rotor being formed at its axially end section with a depression, the vane rotor being connected to said second exhaust valve-side camshaft by a cam bolt piercing the vane rotor along an axis of the vane rotor;

a third driving force transmission member connected to one of the crankshaft and said second intake valve-side camshaft, the housing of said second rotation control mechanism having said third driving force transmission member; and a fourth driving force transmission member installed to an end section of said second exhaust valve-side camshaft together with the vane rotor by the cam bolt and connected to the other of the crankshaft and said second intake valve-side camshaft, said fourth driving force transmission member comprising a generally cup-shaped section which has a cylindrical wall portion fitted on the end section of said second exhaust valve-side camshaft and fitted in the depression of the vane rotor, wherein the vane rotor of said second rotation control mechanism and the generally cup-shaped section of said fourth driving force transmission member are fixed together to the end section of said second exhaust valve-side camshaft upon tightening the cam bolt.

* * * * *